US007070292B2

(12) United States Patent
Kamara et al.

(10) Patent No.: US 7,070,292 B2
(45) Date of Patent: Jul. 4, 2006

(54) ARTICLE WITH BATTERY-ILLUMINATED MEDALLION

(75) Inventors: Michael A. Kamara, Tarzana, CA (US); Heather Dadmanesh, Alexandria, VA (US); Darunee Kamara, Gaithersburg, MD (US)

(73) Assignee: Firejewel, LLC, Rockville, MD (US)

( * ) Notice: Subject to any disclaimer, the term of this patent is extended or adjusted under 35 U.S.C. 154(b) by 245 days.

(21) Appl. No.: 10/837,406

(22) Filed: Apr. 30, 2004

(65) Prior Publication Data

US 2005/0002180 A1 Jan. 6, 2005

Related U.S. Application Data

(63) Continuation-in-part of application No. 10/634,025, filed on Aug. 4, 2003, now Pat. No. 7,000,428, which is a continuation of application No. 09/827,028, filed on Apr. 4, 2001, now Pat. No. 6,601,965, which is a continuation-in-part of application No. 09/498,523, filed on Feb. 4, 2000, now abandoned.

(51) Int. Cl.
*F21V 21/08* (2006.01)
*A45C 15/06* (2006.01)

(52) U.S. Cl. ..... 362/103; 362/104; 362/106; 362/156; 362/253; 63/1.11; 63/20

(58) Field of Classification Search ..... 63/3, 63/3.1, 1.11, 1.16, 20; 362/103–106, 108, 362/156, 253
See application file for complete search history.

(56) References Cited

U.S. PATENT DOCUMENTS

| | | | | |
|---|---|---|---|---|
| 3,968,357 | A | 7/1976 | Hamilton | 362/104 |
| 4,012,629 | A | 3/1977 | Simms | 362/104 |
| 4,101,955 | A | 7/1978 | DuNah | 362/104 |
| 4,170,036 | A | 10/1979 | Sussel | 362/104 |
| 4,186,425 | A | 1/1980 | Nadimi | 362/571 |
| 4,262,324 | A | 4/1981 | Murphy | 362/104 |
| 4,271,457 | A | 6/1981 | Martin | 362/104 |
| 4,459,645 | A | 7/1984 | Glatter | 362/104 |
| 4,779,172 | A | 10/1988 | Jimenez et al. | 362/104 |
| 4,894,757 | A | 1/1990 | Frusha et al. | 362/104 |
| 5,018,053 | A | 5/1991 | Belknap et al. | 362/104 |
| 5,440,461 | A * | 8/1995 | Nadel et al. | 362/103 |
| 5,477,433 | A | 12/1995 | Ohlund | 362/104 |

(Continued)

*Primary Examiner*—Stephen F Husar
(74) *Attorney, Agent, or Firm*—Lieberman & Brandsdorfer, LLC

(57) ABSTRACT

A article of manufacture that includes a luminous medallion. A conductor having a coating of non-conductive material is formed into a loop having two discontinuities. A clasp that houses a removable battery is fixed within the first discontinuity and a bead having an internally embedded LED is located within the second discontinuity. Electrical connections are made to electrodes located within the clasp by interior electrical conductors exposed at the stripped ends of the coated conductors that define one discontinuity. The conductors are fixed in electrical contact with the LED at the other discontinuity at the stripped ends of the coated conductor in the region of the second discontinuity. A membrane with an interior surface and an exterior surface, with the exterior surface adapted to receive the medallion secured thereto, and the interior surface adapted to receive elements of the clasp.

20 Claims, 4 Drawing Sheets

U.S. PATENT DOCUMENTS

| | | | | |
|---|---|---|---|---|
| 5,497,307 | A | 3/1996 | Bae et al. | 362/104 |
| 5,653,530 | A | 8/1997 | Pittman | 362/307 |
| 5,876,109 | A | 3/1999 | Scalco | 362/104 |
| 5,934,784 | A | 8/1999 | Dion | 362/103 |
| 5,951,158 | A | 9/1999 | Upah | 362/571 |
| 6,122,933 | A | 9/2000 | Ohlund | 63/3 |
| 6,233,971 | B1 | 5/2001 | Ohlund | 63/3 |
| 6,296,364 | B1 | 10/2001 | Day et al. | 362/104 |
| 6,601,965 | B1 * | 8/2003 | Kamara | 362/104 |
| 7,000,428 | B1 * | 2/2006 | Kamara et al. | 63/3 |

* cited by examiner

ARTICLE WITH BATTERY-ILLUMINATED MEDALLION

CROSS REFERENCE TO RELATED APPLICATION(S)

The present application is a continuation-in-part of U.S. patent application Ser. No. 10/634,025, filed on Aug. 4, 2003, now U.S. Pat. No. 7,000,428, which is a continuation of U.S. patent application Ser. No. 09/827,028, filed on Apr. 4, 2001, now U.S. Pat. No. 6,601,965, which is a continuation-in-part of U.S. patent application Ser. No. 09/498,523, filed on Feb. 4, 2000, now abandoned.

BACKGROUND OF THE INVENTION

1. Technical Field

This invention relates to an article of manufacture adapted to be illuminated. More particularly, this invention pertains to a housing in communication with a membrane of the article.

2. Description of the Prior Art

There exists a substantial market for articles of manufacture that illuminate. For example, there are handbags that have a light fixture in an interior compartment, and a switch for controlling provision of power to the fixture. The advantages of providing light to an interior compartment is the ability to search the compartment with light provided from the inside thereof. In addition to handbags, there exist a plurality of articles that have illuminating ability. Unfortunately, the design of articles that can be sold at mass market prices while offering an eye catching effect, such as artificial luminance, is complex and difficult. To achieve such an effect, the article must include a power source, preferably compact. In addition, inexpensive prior art articles incorporating a battery-powered device has generally been of limited useful life since inexpensive designs fail to permit battery replacement.

Although there are many items on the market that have illuminating characteristics, most of these items are functional in that they provide light to a specific area where it is need. However, illuminated article can also be used to provide artistic or otherwise aesthetically pleasing affects to the consuming public. Limitations associated with such article is the ability to conceal the functional elements, such as the battery and associated holder, or otherwise make them less intrusive. There is therefore a need for an article adapted to receive a compact power source for delivering electrical energy to a light emitting diode.

SUMMARY OF THE INVENTION

In a first aspect of the invention, an article is provided with a flexible conductor having an exterior coating of non-conductive composition. The conductor forms a loop having first and second discontinuities. A clasp is located within a first discontinuity, and a medallion is located within a second discontinuity. The medallion is adapted to receive the conductor, and the clasp is adapted to receive an electrode from one end of the conductor from one of the loop discontinuities. A membrane with an interior surface and an exterior surface is provided and the medallion is adapted to be secured to the exterior surface of the membrane, and the clasp is adjacent to the interior surface of the membrane. In addition, the membrane has a first aperture adapted to receive the first discontinuity, and a second aperture adapted to receive the second discontinuity.

In a second aspect of the invention, an article is provided with a flexible conductor having an exterior coating of non-conductive composition. The conductor forms a loop having first and second discontinuities, with a connection meals located within the first discontinuity and a light emitting diode within a housing located within the second discontinuity. A membrane with a first side and a second side is provided. The membrane has a first aperture adapted to receive the first discontinuity, and a second aperture adapted to receive the second discontinuity. The housing is adapted to be secured to a first side of said membrane and the connection means having a recess adapted to receive an electrode from one end of the conductor from one of said loop discontinuities.

The preceding and other features and advantages of the present invention shall become further apparent from the detailed description that follows. Such description is accompanied by a set of drawing figures in which numerals, corresponding to those of the written description, are associated with the features of the invention. Like numerals refer to like features throughout both the written description and the drawing figures.

DESCRIPTION OF THE PREFERRED EMBODIMENT

Technical Details

Figure 1:
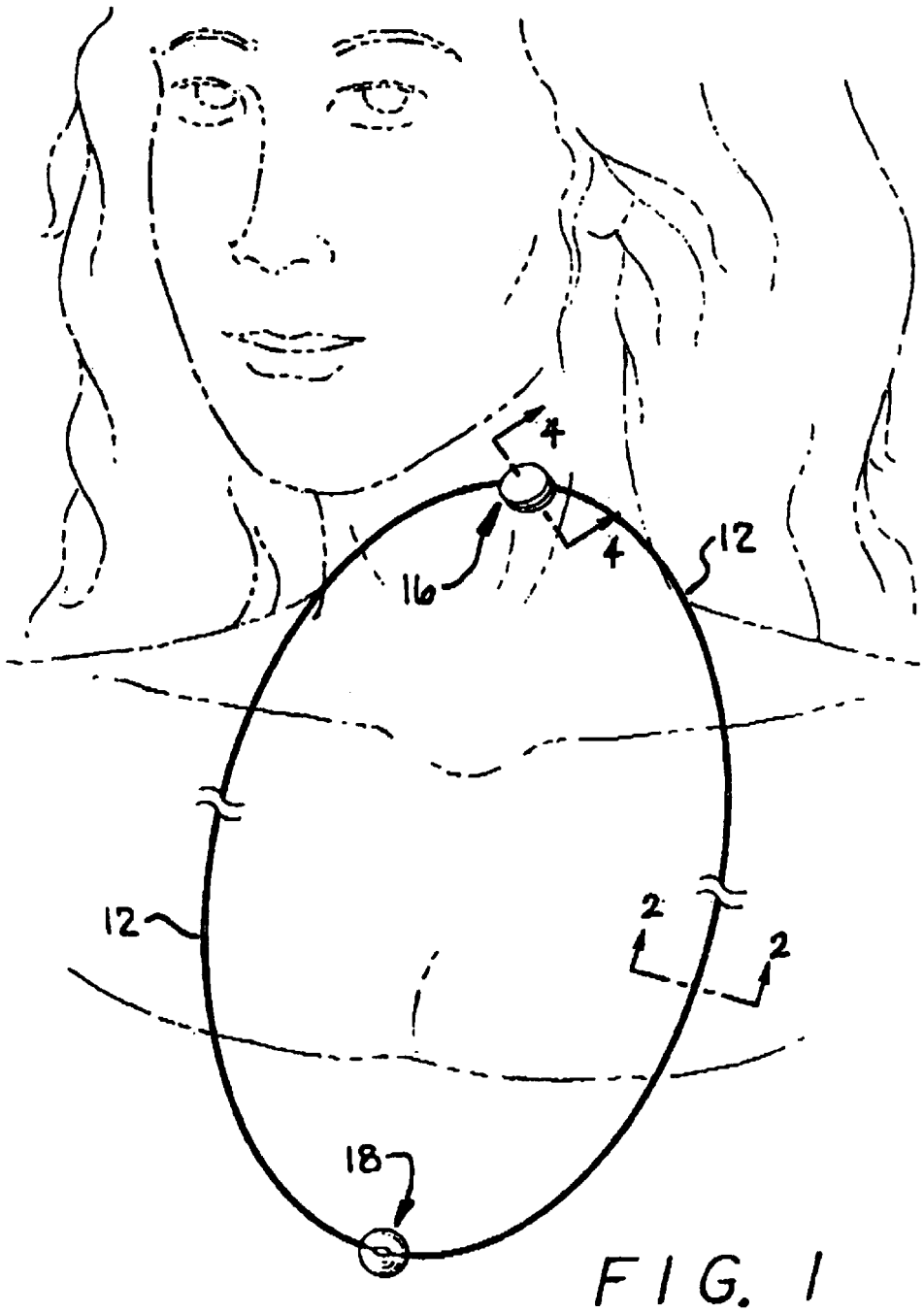
FIG. 1 is a perspective view of a necklace incorporating the invention superimposed upon a wearer shown in shadow outline.
Figure 2:
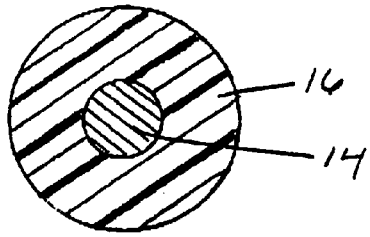
FIG. 2 is a cross-sectional view of the coated conductor of the invention.

Turning to the drawings, FIG. 1 is a perspective view of a necklace 10 incorporating the invention superimposed upon a wearer shown in shadow outline. The necklace 10 generally comprises a coated conductor 12 comprising, as shown in the cross-sectional view of FIG. 2, an internal conductor or wire 14 having a coating 16 of appropriate non-conductive material. An example of a suitable coated conductor is NYLON coated wire. Such a conductor has the advantageous quality of avoiding "kinking" when bent.

Returning to FIG. 1, the coated conductor 12 is formed into a loop for hanging about a wearer's neck, in the case of the necklace, or wrist, in the case of a bracelet, with discontinuities provided for incorporation of an illuminated medallion 18 and a clasp 20 housing a battery structure. As will be seen, an electrical circuit is formed that includes the battery housed within the clasp 20, a battery-powered light emitting device of the medallion 18 and the conductor 14. Such electrical circuit actuates the medallion to emit illumination when energized by the closing of the clasp 20. Thus the clasp 20 serves both to secure the necklace 10 and to house a replaceable battery. By allowing battery replaceability, the useful life of the necklace 10 is not limited by that of the battery, permitting the fabrication of higher quality jewelry as opposed to the lower quality "throw away" items of the prior art.

Figure 3:
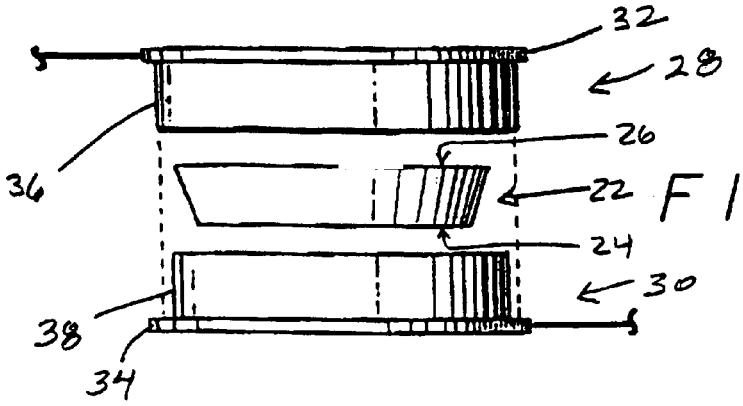
FIG. 3 is an exploded side elevation view of the clasp of an article of jewelry in accordance with the invention, according to the preferred embodiment of this invention, and is suggested for printing on the first page of the issued patent.
Figure 4:
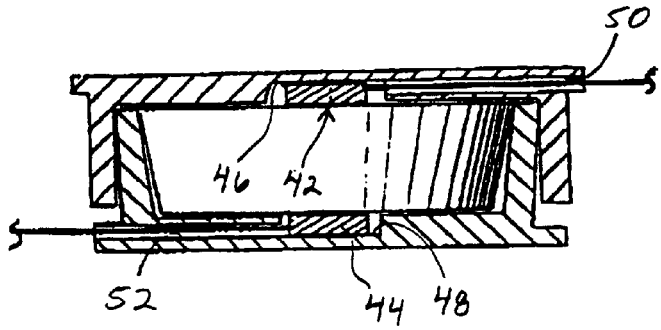
FIG. 4 is a side elevation view in cross-section of an assembled clasp in accordance with the invention.

FIG. 3 is an exploded side elevation view of the clasp 20 of the invention and FIG. 4 is a side elevation view in cross-section of the clasp 20 when the assembly is closed. The clasp 20 has been carefully designed to facilitate the ready removal and replacement of a battery 22 that provides the power for illuminating the medallion 18. The battery 22 is preferably of the nickel cadmium type characterized by an anode surface 24 of less diameter than the cathode surface 26.

The clasp 20 includes coacting upper and lower caps 28 and 30, preferably of molded plastic or other resilient material, respectively. The caps 28, 30 of the small and unobtrusive clasp 20 are particularly designed to facilitate easy access to the interior of the chamber formed therebetween for battery 22 removal and/or replacement. Each cap 28, 30 includes a rim 32 and 34, respectively, that protrudes outside the diameter of a sidewall. In the case of the upper cap 28, the rim 32 protrudes outside the outer diameter of an annular sidewall 36 while, in the case of the lower cap 30, the rim 34 protrudes outside the outer diameter of a sidewall 38.

The rims 32 and 34 greatly facilitate the ability of one to grasp the caps 28 and 30 independently. In addition, as can best be seen in FIG. 4, the clasp 20 has been carefully dimensioned so that, when closed, the sidewall 38 of the lower cap 30 is forced outwardly by the maximum outer diameter of the enclosed battery 22 so that a press-fit is obtained with the interior of the sidewall 36 of the upper cap 28. Such interaction is obtained by careful dimensioning of the inner diameter of the sidewall 38 with the dimensions of the battery 22 and the outer diameter of the sidewall 38 with the inner diameter of the sidewall 36.

In addition to the locking arrangement illustrated in FIG. 4, a tight pressure fit exists between the battery 22 and the interior of the rim 34 of the lower cap 30 that retains the battery 22 within the clasp 20 even when the two caps 28 and 30 are disengaged from one another. This permits one to use and wear the device as an ordinary piece of jewelry, unlocking the clasp 20 to remove the necklace, for example, from one's neck without concern that the battery 22 will be lost.

When battery replacement is required, this is easily accomplished by pushing a thin rod-like element upward through an aperture 40 that is provided in a bottom area of the lower cap 30 within the thickened central area of the rim 34 circumscribed by the inner circumference of the sidewall 38.

Electrodes 42, 44 are received within central recesses 46, 48 at the thickened inner surfaces of the rims 32 and 34 respectively. Each of the rims 32 and 34 includes a tunnel 50, 52 for receiving an end of the coated conductor 12 adjacent to a loop discontinuity. Referring to FIG. 4 in particular, it can be seen that the portions of the ends of the coated conductor 12 interior to the rims 32 and 34 are stripped to exposed the conductor wire 14. The wire 14 is, in each case, joined to an electrode 42 or 44, after being threaded through one of the tunnels 50, 52 by crimping with a metal crimp bead to form a flat, square contact that cannot transverse backward through the tunnel 50 or 52 as each bead assembly is much larger than the tunnel through which it was originally received. As a result, no adhesives for securing either electrodes or wires are required within the interior of the clasp 20.

Figure 5:
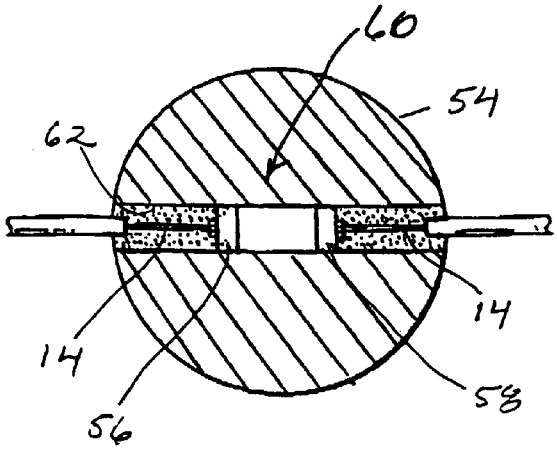
FIG. 5 is a cross-sectional view of the luminous medallion of the invention.

FIG. 5 is a cross-sectional view of the medallion 18 of the necklace 10. The medallion 18 comprises a spherical bead 54, smooth or faceted, of transparent or translucent, clear or tinted, material that receives end of the coated conductor 12 in the region of a second loop discontinuity. The ends of the coated conductor 12, stripped to expose the interior conductor wire 14, electrically contact positive and negative terminal receptors 56 and 58 of a light emitting diode (LED) 60. The LED 60 is of the surface mounted type, permitting the arrangement as shown in FIG. 5 and may comprise, for example, a device commercially available under Part No. KPT 2021HD from Kingbright Corporation of City of Industry, Calif. Such a LED is available in red, blue, green, amber, and white. The invention is, however, not limited to such a LED.

The bead 54 of the medallion 18 includes a diametrical hole 62 forming a channel therethrough. To assemble, the LED 60 is inserted into the channel after insertion of the surface mounted LED therein with positive and negative terminal receptors 56 and 58 facing opposed channel entrances. The exposed conductor 14 at the ends of the stripped coated conductor 12 are separately inserted into the end of the channel to contact the LED 60. Once contact is made with one of the opposed terminals, an appropriate non-conductive adhesive, such as silicone glue, is injected into the channel and allowed to harden to maintain contact between that terminal and the conductor or wire 14. This process is repeated to obtain secure contact between the wire 14 and each of the terminal receptors 56 and 58, resulting in a simple, yet rugged configuration. The use of silicone glue assures that the channel will remain clear and in no way affect the appearance of the bead 54 when illuminated.

Employing a surface mounted LED 60 enables the use of a small bead-like medallion 18 that is illuminated from within. This is to be contrasted with illuminated medallion-type ornamentation that employs bullet mounted LEDs such as that taught in U.S. Pat. No. 6,122,933 issued to Stephen K. Ohlund on Sep. 26, 2000 for "Jewelry Piece". Such LEDs operate at a higher voltage (requiring the use of multiple batteries and thereby necessitating a bulkier clasp) and, as in the above patent, requiring an arrangement other than the simple and durable arrangement of the invention in which wires enter into the interior of a bead to contact opposite sides of a LED. This is due to the fact that bullet-mounted LEDs are bulkier (approximately 0.75 mm vs. 3 mm in cross section) than surface mounted LEDs and the output pins of such LEDs are parallel to one another, exiting the LED from the same side. Such terminal configuration prevents the mounting of such a source wholly within a small bead as in the invention. The mounting of the light source wholly within a relatively small bead 54 generates a more brilliant and dramatic effect than possible in devices limited to indirect illumination as a consequence of the use of bullet type LED sources such as that of U.S. Pat. No. 6,122,933.

When assembled, the necklace 10 (alternatively, a bracelet may be formed with a shortened coated conductor 12) is then operable as a piece of luminous jewelry with illumination emanating through the bead 54 of the medallion 18 since the LED 60 is in electrical contact with the battery 22 power supply through the conductor 14 when the clasp 20 is closed and secured as shown in FIG. 4.

Figure 6:
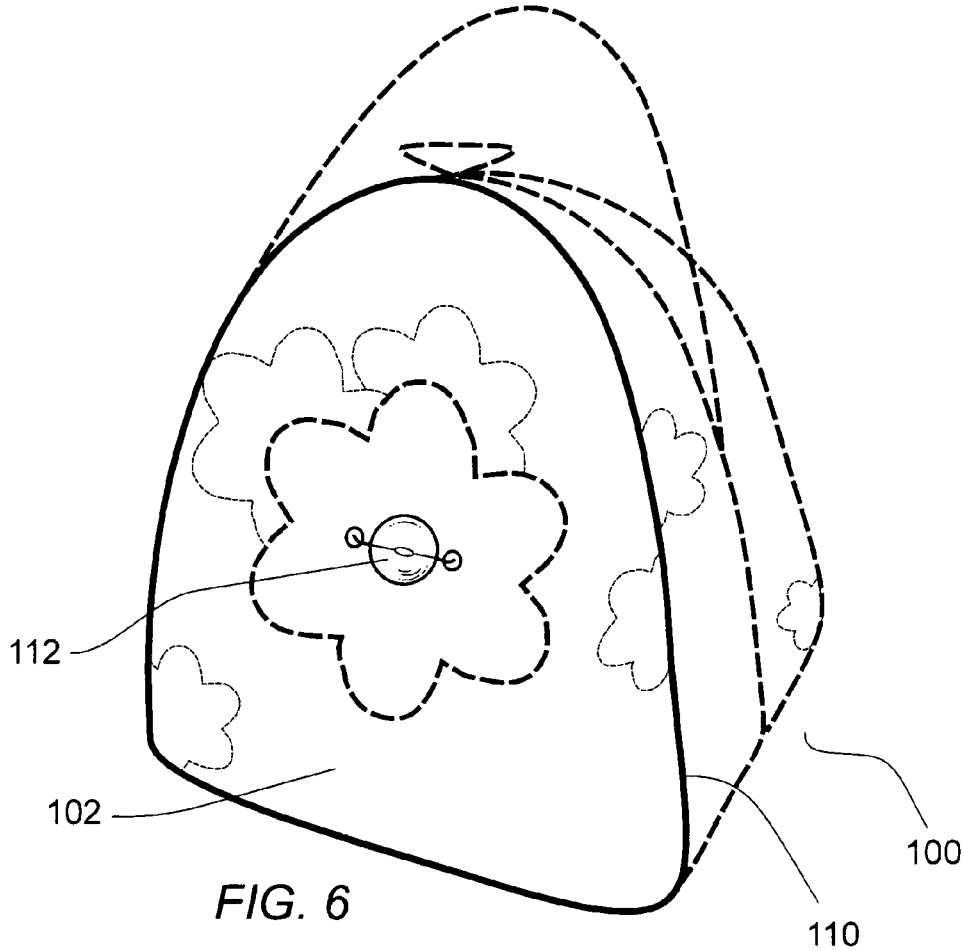
FIG. 6 is a perspective view of a handbag with the medallion secured thereto.
Figure 7:
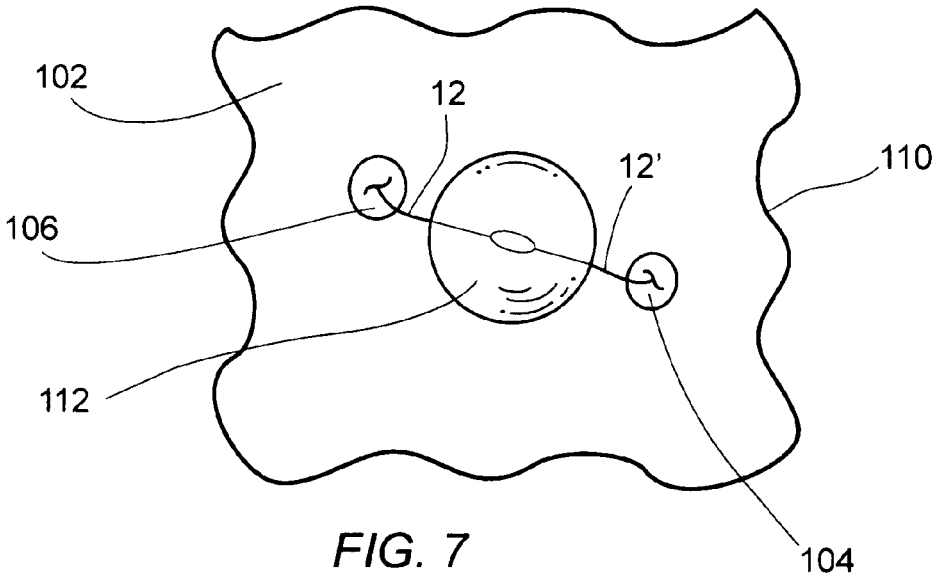
FIG. 7 is a front view of an exterior surface of the membrane.
Figure 8:
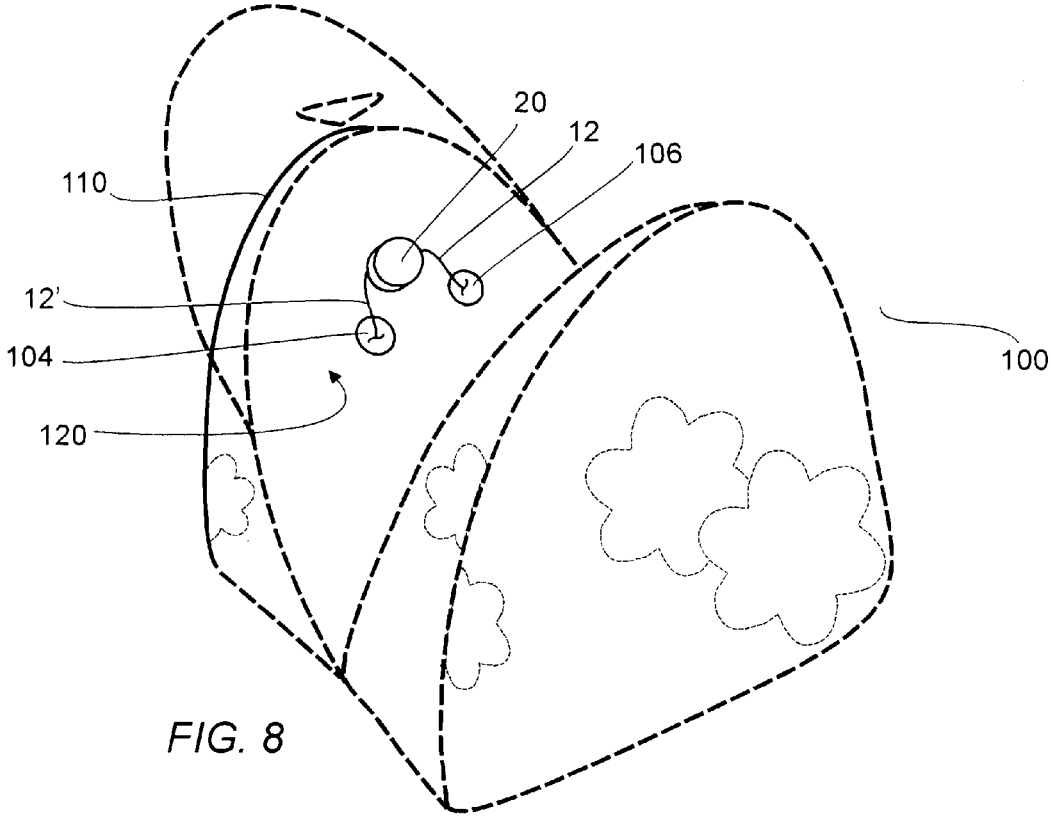
FIG. 8 is a perspective view of the handbag showing an interior surface of an associated membrane.
Figure 9:
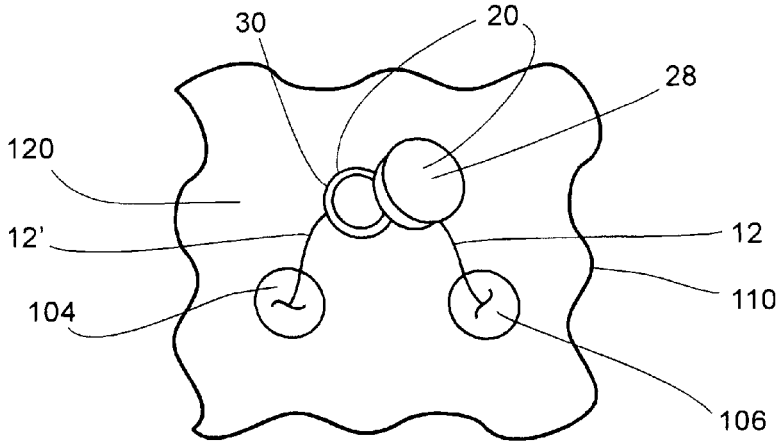
FIG. 9 is a front view of the interior membrane of the handbag.

FIG. 6 shows a handbag 100 with the medallion 112 fixed to an exterior surface thereof. The medallion 112 is based upon the same engineering principles of the medallion 18 shown in FIGS. 1–4. As shown in FIG. 6, the handbag 100 has an exterior surface 102, that essentially is a membrane. The medallion 112 is shown on the exterior surface 102 of a membrane 110 of the handbag 100. FIG. 7 is s front view of the exterior surface 102 of the handbag 100. As shown in this view, there are two apertures 104, 106 in the exterior surface 102 of the membrane 110. Each of the apertures 104, 106 is adapted to receive one of the first and second discontinuities 12, 12', which are in communication with both the medallion 112 and the members of the clasp 20. FIG. 8, is a perspective view of the handbag 100 showing an interior surface 120 of the membrane 110 with the first and second discontinuities 12, 12' extended through each of the associated apertures 104, 106. As shown herein, the clasp 20 resides adjacent to the interior surface 120 of the membrane. FIG. 9 is s front view of the interior surface 120 of the membrane 110 showing the discontinuities 12, 12' received through the associated apertures 104, 106, and the clasp 20 adjacent to the interior surface of the membrane. As shown herein, both the upper cap 28 and the lower cap 30 reside adjacent to the interior surface 120 of the membrane 110. The elements of the clasp may be placed adjacent to the interior surface 120, or secured to the membrane 110. Accordingly, the placement of an aperture through a membrane 110 enables the technology of the clasp and illuminating medallion to be applied to an article with a membrane.

It will be appreciated that, although specific embodiments of the invention have been described herein for purposes of illustration, various modifications may be made without departing from the spirit and scope of the invention. In particular, the clasp elements that reside adjacent to the interior surface of the membrane may be secured to the interior surface thereby affecting the mobility of the upper and lower caps of the clasp. Additionally, a secondary enclosure may be provided adjacent to the interior surface of the membrane. The purpose of the secondary enclosure is to receive the upper and lower caps, and possibly a portion of the first and second discontinuities therein. The secondary enclosure functions to conceal the upper and lower caps of the clasp, and possibly a portion of the discontinuities. In a further embodiment, the secondary enclosure may be secured to a specific area of the interior surface of the membrane, or possibly near the interior surface of the membrane. Accordingly, the scope of protection of this invention is limited only by the following claims and their equivalents.

We claim:

1. An article comprising:

a) a flexible conductor having an exterior coating of non-conductive composition;

b) said conductor forming a loop having first and second discontinuities;

c) a clasp located within a first discontinuity;

d) a medallion located within a second discontinuity;

e) said medallion adapted to receive said conductor;

f) said clasp adapted to receive an electrode from one end of said conductor from one of said loop discontinuities; and g) a membrane with an interior surface and an exterior surface, said medallion adapted to be secured to said exterior surface of said membrane, said clasp adjacent to said interior surface of said membrane, a first aperture in said membrane adapted to receive said first discontinuity, and a second aperture in said membrane adapted to receive said second discontinuity.

2. The article of claim 1, further comprising an aperture adapted to extend through said membrane to receive said conductor.

3. The article of claim 1, further comprising a diametrical aperture adapted to form a channel through said medallion.

4. The article of claim 3, further comprising a surface mount light emitting diode housed within said diametrical aperture.

5. The article of claim 4, further comprising a conductor from one of said discontinuities in secure contact with a terminal receptor of said light emitting diode.

6. The article of claim 4, further comprising said light emitting diode in a radially equidistant position from an exterior surface of said medallion.

7. The article of claim 6, wherein said radially equidistant position of said light emitting diode provides an even distribution of illumination.

8. The article of claim 1, wherein said clasp is mounted to said interior surface of said membrane.

9. The article of claim 1, wherein said membrane is a material adapted for use selected from a group consisting of: a bag, a hat, a shoe, a jacket, handbags, pins, belts, clothing, gloves, tiaras, and hairbands.

10. The article of claim 1, further comprising an enclosure adapted to receive said clasp.

11. The article of claim 1, wherein said clasp is adapted to be secured to said interior surface of said membrane.

12. An article comprising:

(a) a flexible conductor having an exterior coating of non-conductive composition;

(b) said conductor forming a loop having first and second discontinuities;

(c) a connection means located within said first discontinuity;

(d) a light emitting diode within a housing located within said second discontinuity;

(e) a membrane with a first side and a second side;

(f) a first aperture in said membrane adapted to receive said first discontinuity, and a second aperture in said membrane adapted to receive said second discontinuity;

(g) said housing adapted to be secured to a first side of said membrane; and (h) said connection means having a recess adapted to receive an electrode from one end of said conductor from one of said loop discontinuities.

13. The article of claim 12, wherein said connection means is adapted to receive a battery.

14. The article of claim 13, wherein said electrode of said housing is adapted to contact a terminal of said battery.

15. The article of claim 14, wherein contact of said battery terminal with said electrode illuminates said light emitting diode.

16. The article of claim 12, wherein said housing comprises a first aperture adapted to receive said electrode therethrough.

17. The article of claim 16, wherein said electrode having a cross section area greater than a cross section area of said first aperture.

18. The article of claim 12, wherein said membrane is a wall of an object selected from a group consisting of: a bag, a hat, a shoe, a jacket, handbags, pins, belts, clothing, gloves, tiaras, and hairbands.

19. The article of claim 12, wherein said membrane has a property selected from a group consisting of: flexible and rigid.

20. The article of claim 12, further comprising a cover adapted to conceal said housing.

* * * * *